US006631597B1

(12) United States Patent
Rutherford

(10) Patent No.: US 6,631,597 B1
(45) Date of Patent: Oct. 14, 2003

(54) BULLNOSE BASE/CROWN CORNER PLUG

(75) Inventor: Barry Rutherford, Chatsworth, CA (US)

(73) Assignee: Flannery, Inc., San Fernando, CA (US)

( * ) Notice: Subject to any disclaimer, the term of this patent is extended or adjusted under 35 U.S.C. 154(b) by 0 days.

(21) Appl. No.: 09/925,906

(22) Filed: Aug. 9, 2001

Related U.S. Application Data

(60) Provisional application No. 60/224,565, filed on Aug. 10, 2000.

(51) Int. Cl.[7] ..... E04B 2/00

(52) U.S. Cl. ..... 52/287.1; 52/273; 52/716.1

(58) Field of Search ..... 52/287.1, 273, 52/275, 277, DIG. 1, 716.1; D25/136; D8/406, 47

(56) References Cited

U.S. PATENT DOCUMENTS

D351,988 S * 11/1994 Gotcher ..... D8/403
5,615,530 A * 4/1997 Kartler ..... 52/745.09
5,960,598 A * 10/1999 Tamlyn ..... 52/254
6,438,914 B1 * 8/2002 Robertson ..... 52/255

* cited by examiner

*Primary Examiner*—Carl D. Friedman
*Assistant Examiner*—Jennifer I. Thissell
(74) *Attorney, Agent, or Firm*—Christie, Parker & Hale, LLP

(57) ABSTRACT

A corner plug is disclosed for filling a cavity created between a wall corner bullnose and a squared-off molding, having an upper portion and a lower portion, both portions having a concave back surface. A shoulder formed at the intersection of the upper and lower portions is dimensioned to traverse and cover the cavity between the wall corner bullnose and the squared-off molding. In one embodiment of the present invention, the back surface is dimensioned to continuously contact the wall corner bullnose. The upper portion is preferably thicker than the lower portion and the lower portion preferably tapers to facilitate the insertion of the plug into the cavity. In one embodiment of the invention, the front surface of the lower portion includes two planar members that intersect at an edge, corresponding to the edge portion of the molding. The corner plug can be constructed from any rigid material, including plastic, wood, metal, or other similar material.

20 Claims, 2 Drawing Sheets

BULLNOSE BASE/CROWN CORNER PLUG

CROSS-REFERENCE TO RELATED APPLICATIONS

This application claims the benefit of U.S. Provisional Application No. 60/224,565 file date Aug. 10, 2000.

FIELD OF INVENTION

This invention relates generally to finishing wall moldings used in the construction industry and, more particularly, to a finishing wall molding that is used at a 90 degree wall corner bullnose surface.

BACKGROUND OF THE INVENTION

In the construction industry, for a business to be successful, the job must be performed quickly, cost effectively, and attractively. The difficulty arises in balancing these three factors. There is a constant need for implements and tools that allow constructors to build an attractive product while minimizing the cost and the time commitment required to complete the task. Efforts are continuously being made to develop tools, methods and other construction systems that increase the speed and efficiency of the construction, yet allow the construction worker to maintain high-quality construction standards.

One creative technique that has re-emerged in the construction industry is rounding outside corner of walls to create so-called bullnose corners. Although this popular design is attractive, a problem is created when a molding, such as a baseboard molding, corner molding, crown molding, or wainscot, is used in conjunction with the bullnose corner. The problem is that the moldings are generally designed for 90 degree squared-off corners. Thus, when these rectangular moldings are used on the bullnose corners, an unattractive gap is created between the bullnose corner and the rectangular molding.

On inexpensive way of addressing the problem has been to fill the gap created between the bullnose corner and the 90 degree molding with caulking or the like. Although, caulking is a low-cost solution, it is also involves a time-consuming process of filling each gap, cleaning up excess caulk, and waiting for the caulk to dry. Further, while the caulked does fill the gap, the filled gap does not have a finished look, oftentimes looking irregular or rough.

It is, therefore, desired that device be constructed that is capable of filling the gap that exists between a bullnose wall corner surface and a 90 degree molding, and doing so in a an efficient, cost-effective matter, that further provides a finished and attractive look.

SUMMARY OF THE INVENTION

It is an object of the present invention to provide a construction device that eliminates the gap between the wall corner bullnose and the squared-off molding without requiring expensive new tools.

It is a further object of the present invention to provide an easy method of filling the gap between the wall corner bullnose and the squared-off molding that does not require an extended time commitment.

It is another object of the present invention to provide a corner plug that presents an attractive transition between the wall corner bullnose and the squared-off molding.

A corner plug is disclosed for filling a cavity created between a wall corner bullnose and a squared-off molding, having an upper portion and a lower portion, both portions having a concave back surface. A shoulder formed at the intersection of the upper and lower portions is dimensioned to traverse and cover the cavity between the wall corner bullnose and the squared-off molding. In one embodiment of the present invention, the back surface is dimensioned to continuously contact the wall corner bullnose. The upper portion is preferably thicker than the lower portion and the lower portion preferably tapers to facilitate the insertion of the plug into the cavity. In one embodiment of the invention, the front surface of the lower portion includes two planar members that intersect at an edge, corresponding to the edge portion of the molding. The corner plug can be constructed from any rigid material, including plastic, wood, metal, or other similar material.

The corner plug of the present invention can be manufactured inexpensively and does not require unique and expensive tools to install. The corner plug can be installed by pushing it into the gap between the wall corner bullnose and the squared-off molding by hand. Alternatively, a hammer can be used to secure the corner plug in the gap. The process of installing the corner plug is fast and can be completed within seconds. Unlike caulking, there is no waiting period for drying and no mess to clean up.

This invention, together with the additional features and advantages thereof, which was only summarized in the foregoing passages, will become more apparent to those of skill in the art upon reading the description of the preferred embodiments, which follows in the specification, taken together with the following drawings.

DETAILED DESCRIPTION OF THE INVENTION

Figure 1:
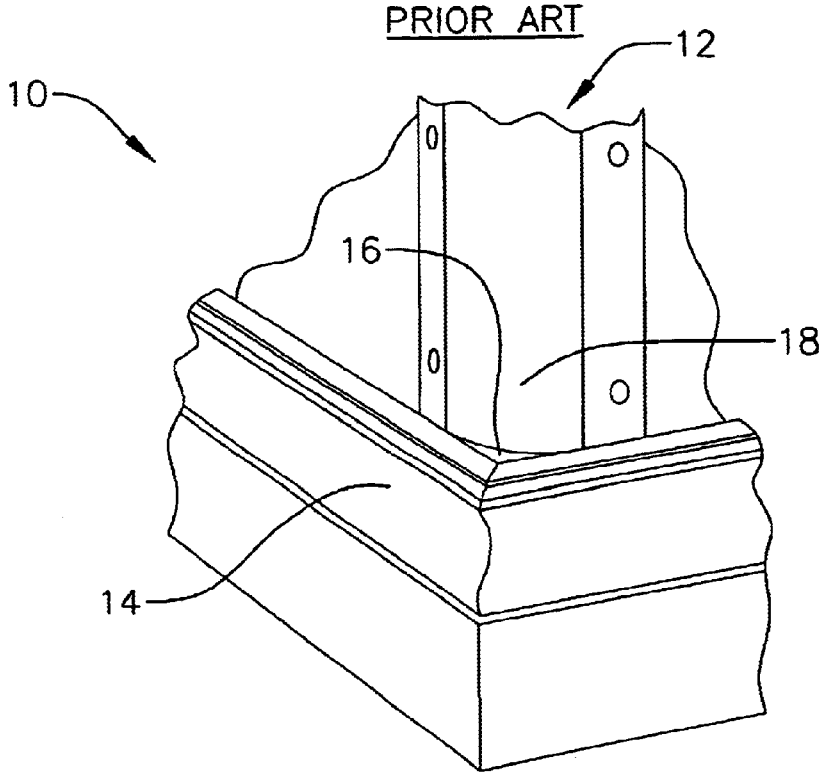
FIG. 1 PRIOR ART
FIG. 1 is a perspective view of a known interior wall corner where a transition exists between a wall corner bullnose and a squared-off base or crown molding.

FIG. 1 shows a known interior wall corner 10 where a transition exists between a wall corner bullnose 12 and a squared-off 90 degree molding 14. It can be seen from the figure that when a 90 degree molding is used on the bullnose corner 12, an unattractive gap or cavity 16 is formed between the molding and the bullnose.

Figure 2:
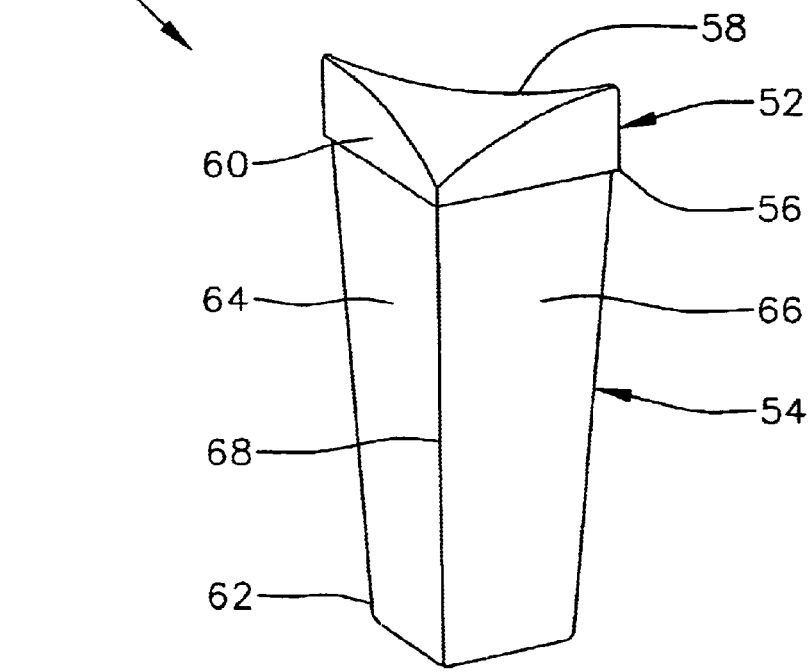
FIG. 2 is a perspective view of the corner plug of the present invention.

FIG. 2 shows a corner plug 50 of the present invention, which can used to fill the cavity 16 between the wall corner bullnose 12 and the squared-off molding 14. The corner plug 50 includes an upper portion 52, a lower portion 54, and a shoulder 56 defined at the intersection of the upper and lower portions 52, 54. In a preferred embodiment of the invention, the back surface 58 of the corner plug 50 is concave to complement the round edge 18 (shown in FIG. 1) of the wall corner bullnose. The front surface 60 of the upper portion is preferably rounded as well. In one embodiment of the invention, the front surface 62 of the lower portion 54 can also be rounded to facilitate the insertion of the lower portion 54 into the cavity 16.

According to an alternative embodiment, the lower portion 54 of the corner plug 50 includes a first planar member 64 and a second planar member 66 that adjoin at an edge 68. The edge 68 is preferably dimensioned to complement the shape of the squared-off molding 14. In one embodiment of the invention, the first planar member 64 is perpendicular to the second planar member 66.

Figure 3:
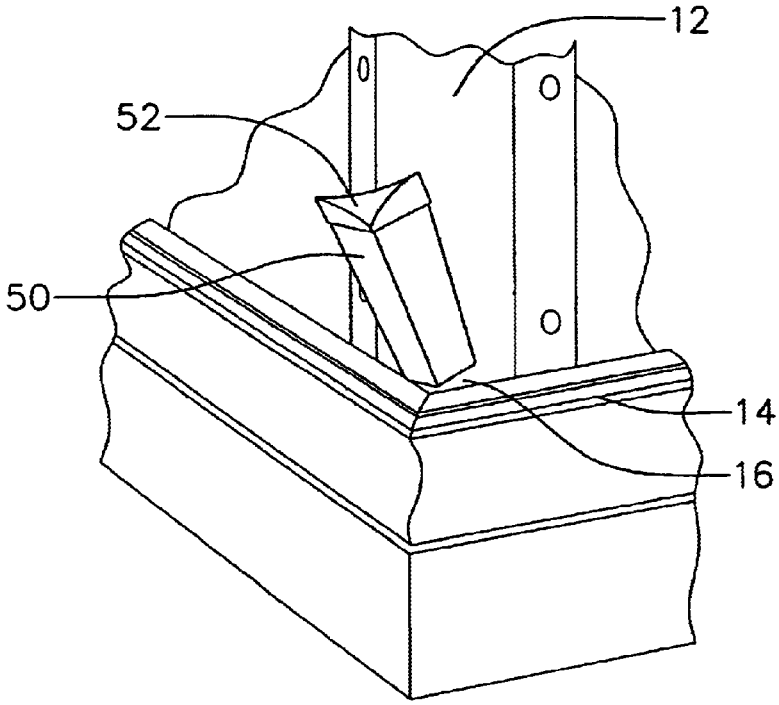
FIG. 3 is a perspective view of the corner plug of the present invention being inserted in the gap between the wall corner bullnose and the squared-off base molding.
Figure 4:
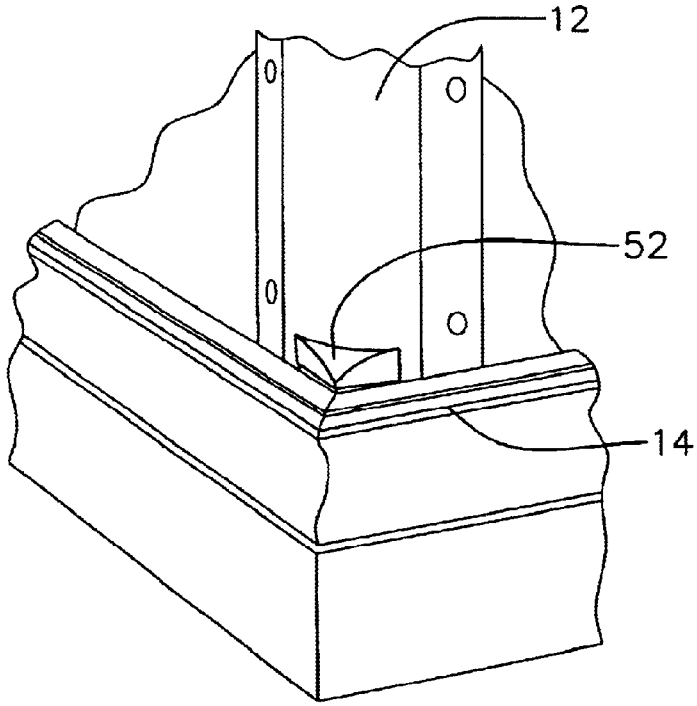
FIG. 4 is a perspective view of the corner plug of the present invention fully inserted in the gap between the wall corner bullnose and the squared-off base molding such that the shoulder of the corner plug traverses and covers the gap.

The shoulder 56 is designed to provide a transition or a step between the surface of the bullnose and the squared-off base or crown molding. The corner plug 50 is installed in the cavity 16 by inserting the lower portion 54 of the plug 50 into the cavity 16, as shown in FIG. 3. The installation can be done manually or with the use of a hammer to ensure that the corner plug 50 is secured in the cavity. The corner plug 50 is preferably inserted into cavity 16 until the shoulder 56 traverses the cavity. The shoulder 56 is preferably dimensioned to cover the cavity 16 entirely, thereby providing a seamless and finished looking transition. When the installation is complete, the lower portion 54 of the corner plug 50 will be positioned entirely within the cavity 16, while the upper portion 52 of the corner plug 50, as shown in FIG. 4, will be above the cavity 16 providing a transition between the wall corner bullnose 12 and the squared-off molding 14.

The length of the lower portion 54 of the corner plug 50 can be varied depending on the desired application. In a preferred embodiment, the lower portion 54 of the corner plug is tapered, gradually decreasing in width from the shoulder 56 to the bottom of the lower portion 54. The use of a tapered width configuration helps to facilitate inserting the corner plug 50 into the cavity 16.

The thickness of the lower portion 54 of the corner plug 50 can also vary depending on the application. In a preferred embodiment, the thickness of the lower portion 54 is tapered, gradually decreasing in width moving away from the shoulder 56 along the length of the lower portion 54. The lower portion 54 preferably is thickest at or near the shoulder 56 of the corner plug 50. The thickness gradually decreases along the length of the lower portion as the distance from the shoulder increases. The tapering in both the length and the thickness of the lower portion 54 of the plug 50 allows the plug to fit any size base or crown regardless of the height or thickness.

The corner plug can be manufactured from any rigid material, including without limitation, plastic, wood, metal, a composite material or any other similar material that can maintain its structural integrity.

The corner plug of the present invention provides a simple, inexpensive means of covering the cavity between the wall corner bullnose and the squared-off molding in a manner that, unlike the current method of caulk filling, provides a transition that is consistently finished and attractive-looking in each use. There is no requirement for an unusual or expensive tool to install the plug. The corner plug can be installed manually by pushing it into the gap between the wall corner bullnose and the squared-off molding by hand. The process of installing the corner plug is fast and can be completed within seconds. The shoulder of the corner plug presents an attractive transition between the wall corner bullnose and the molding. Accordingly, the present invention meets all the goals of the construction industry in that is cost-effective, attractive and capable of being done quickly.

It will be understood that various modifications can be made to the disclosed embodiments of the present invention without departing from the spirit and scope thereof. Therefore, the above description should not be construed as limiting the invention, but merely as an exemplification of preferred embodiments thereof. Those of skill in the art will envision other modifications within the scope and spirit of the present invention as defined by the appended claims.

What is claimed is:

1. A corner plug for closing a cavity created between a wall corner bullnose and a squared-off molding, comprising:

an upper portion having a concave back surface;

a lower portion having a concave back surface, the lower portion being insertable in the cavity between the wall corner bullnose and the squared-off molding; and an outwardly extending shoulder defining the junction between the upper and lower portions, the upper portion being dimensioned to traverse and cover the cavity between the wall corner bullnose and the squared-off molding with the upper portion extending from the squared-off molding, the upper portion having a thickness greater than the thickness of the lower portion.

2. A corner plug according to claim 1, wherein the lower portion further comprises a front surface having a first planar member and a second planar member adjoining at an edge to slidably engage the interior surface of the squared-off molding.

3. The corner plug according to claim 1 wherein the concave back surface of the upper portion is dimensioned to continuously contact the wall corner bullnose.

4. The corner plug according to claim 1 wherein the concave back surface of the lower portion is dimensioned to continuously contact the wall corner bullnose.

5. A corner plug according to claim 2 wherein the first planar member of the front surface of the lower portion is perpendicular to the second planar member.

6. A corner plug according to claim 1 wherein the lower portion tapers downwardly from the shoulder.

7. A corner plug according to claim 1 comprising a plastic material.

8. A corner plug according to claim 1 comprising a wood material.

9. A corner plug according to claim 1 comprising a metal material.

10. A corner plug according to claim 1, wherein the lower portion further comprises a front surface having an angled configuration.

11. A corner plug according to claim 1, wherein the upper portion further comprises a front surface having an angled configuration protruding outwardly from the lower portion.

12. The corner plug according to claim 1 wherein the concave back surfaces of the upper and lower portions constitute a continuous surface.

13. A corner plug for filling a gap created between a wall corner bullnose and a squared-off molding, comprising:

an upper portion having a concave back surface;

a lower portion having a concave back surface, the lower portion being insertable in the gap between the wall corner bullnose and the squared-off molding; and a downwardly facing shoulder defining the junction between the upper and lower portions, wherein insertion of the lower portion into the gap positions the shoulder against the squared-off molding such that the upper portion provides a transition surface between the squared-off molding and the wall corner bullnose, the upper portion having a thickness greater than the thickness of the lower portion.

14. A corner plug according to claim 13, wherein the lower portion further comprises a front surface having a first planar member and a second planar member adjoining at an edge.

15. The corner plug according to claim 13 wherein the concave back surface of the upper portion is dimensioned to continuously contact the wall corner bullnose.

16. The corner plug according to claim 13 wherein the concave back surface of the lower portion is dimensioned to continuously contact the wall corner bullnose.

17. A corner plug according to claim 14 wherein the first planar member of the front surface of the lower portion is perpendicular to the second planar member.

18. A corner plug according to claim 13 wherein the lower portion tapers downwardly from the shoulder.

19. A corner plug according to claim 13, wherein the lower portion further comprises a front surface having an angled configuration.

20. A corner plug according to claim 13, wherein the upper portion further comprises a front surface having an angled configuration protruding outwardly from the lower portion.

* * * * *